US005290165A

United States Patent [19]

Pitha

[11] Patent Number: 5,290,165

[45] Date of Patent: Mar. 1, 1994

[54] INDEPENDENT PALLET DELIVERY SYSTEM

[75] Inventor: Jay R. Pitha, Bethlehem, Pa.

[73] Assignee: Bergen Machine & Tool Co., Inc., Hacketstown, N.J.

[21] Appl. No.: 878,594

[22] Filed: May 5, 1992

[51] Int. Cl.[5] ..... B28B 15/00; B28B 5/00

[52] U.S. Cl. ..... 425/150; 425/253; 425/254; 425/452; 425/453

[58] Field of Search ..... 425/136, 138, 150, 168, 425/253, 254, 255, 452, 453, 454, DIG. 108; 264/40.7

[56] References Cited

U.S. PATENT DOCUMENTS

| | | | |
|---|---|---|---|
| 2,566,787 | 9/1951 | Zevely | 425/253 |
| 2,692,418 | 10/1954 | Besser | 425/253 |
| 3,612,159 | 10/1971 | Galinsky | 425/452 |
| 3,677,686 | 7/1972 | Powel | 425/253 |
| 3,833,331 | 9/1974 | Springs | 425/253 |
| 5,024,593 | 6/1991 | Hehe | 425/253 |

FOREIGN PATENT DOCUMENTS

| | | | |
|---|---|---|---|
| 1296430 | 3/1987 | U.S.S.R. | 425/254 |

*Primary Examiner*—Khanh Nguyen
*Attorney, Agent, or Firm*—Blum Kaplan

[57] ABSTRACT

An independent pallet delivery system for transporting pallets through a block forming machine that forms concrete blocks on a pallet. The systems includes a pallet magazine for storing a plurality of pallets therein. A conveyor belt formed with a pulley system for transporting the pallets. A pallet pick-up position which receives a pallet from the pallet magazine and places the pallet in a holding position above the conveyor. A jacking assembly is provided to raise that conveyor to engage with the pallet and deliver the pallet to the block forming machine. The block forming machine lifts the empty pallet and forms a molded block thereon. As the block forming machine lowers the pallet towards the conveyor, the jacking assembly lowers the conveyor to cushion the return of the pallet having the molded cement blocks thereon. The pallet with the molded concrete blocks is placed on the conveyor and a takeaway conveyor which move at essentially the same speed and outputs the pallet to an automated conveyor.

31 Claims, 11 Drawing Sheets 102
104
107
107
108
110
132
133
134
135
136
136
136
138

INDEPENDENT PALLET DELIVERY SYSTEM

BACKGROUND OF THE INVENTION

This invention relates to a pallet delivery system for a cam driven block machine and, in particular to, an independent pallet delivery system which reduces vibration to a pallet and hence optimizes formation and movement of a molded block, expedites the storage and handling of pallets and minimizes the wear on pallets that can result in down time caused by worn pallets.

In the early stages of concrete block manufacturing, concrete blocks were made in a single cavity mold by mixing sand, gravel and cement and then hand packing the mixture into a mold. When the material was packed at the proper consistency, the sides of the mold were folded down and the blocks were removed. Subsequently, the technology improved in the 1930's with the development of cam driven block machines. One such machine is described in detail in U.S. Pat. No. 2,692,418 and the basic process, thereof, which permits three molded blocks to be formed at one time has been and continues to be an industry standard.

Specifically, such cam driven block machines manufacture three standard eight inch blocks in an 8–10 second production cycle. These types of block machines are also capable of making different shapes and sizes of blocks. Concomitantly, block machines are powered by a ten to fifteen horse power electric motor through a clutching device and a series of gears which turn the main cam shaft of the machine. The cam shaft is formed with various other camming systems which operate functions that occur during each production cycle. The block machines further include shafts with arms and rollers that contact the cams. For example, one cam system operates the feed box coming out over the mold and fills the mold with a concrete mix. Another cam system allows the compaction head to drop onto the mold to compact the material. When the cement block is compacted, another camming system drops down a freshly made block (referred to commonly as green blocks), while another camming system permits the pallet receiver to receive the freshly made green blocks from the compacting head.

Another camming system comprised of shafts, cams, rollers, chains, lugs and sprockets cause the empty steel pallets upon which the green blocks are formed and delivered to enter the machine. These components define a dependent pallet delivery system. The dependent pallet delivery system of the cam driven block machine then transports the pallet to a position under the mold where the pallet receiver lifts the pallet from the dependent pallet delivery system and receives the freshly made green blocks on the pallet as the blocks are stripped out of the mold. The cam driven block machine then transports the pallet and the green blocks to a takeaway conveyer.

One disadvantage of the known pallet delivery systems is the fact that they are dependent on the rotation of the cams and shafts of the cam driven block machine to carry the pallet through the process of forming the blocks. The dependent pallet delivery system is provided with a magazine to store the pallets one on top of the other. Although this system has been used for decades in the industry, a number of problems in the manufacturing process occur due to the rough handling of both the pallets and the freshly made blocks.

First, as the empty pallet enters the pallet magazine, the empty pallet slams into other pallets in the magazine as well as the sides of the pallet magazines causing wear on the pallet magazine and the pallet itself. This slamming action is a noisy operation which repeats itself three to four thousand times a day in a typical manufacturing facility. More significantly, the vibration created from the slamming pallets is transferred to the freshly made green blocks being delivered to the conveyor transporting the green blocks. This vibration transferred to the block causes inherent weakness in the blocks as they are transported to the takeaway conveyor hence resulting in some cracked blocks being discarded before or after curing.

Another problem is caused by the manner in which pallets are moved through the machine to the mold area with a heavy chain having lugs. The chain and lugs contact the edge and the bottom of a pallet during transportation and also when the pallets are stacked in the pallet magazine. The chain and lugs then drag a pallet from under the stack into the machine area. During this operation, the pallet lugs create considerable wear and stress on the edges of the pallet. In addition, the heavy pallet causes wear on the magazine, and therefore the heavy chain and lugs also require a considerable amount of maintenance. Similarly, the engagement of the lugs and chain with the pallets also causes vibrations which are transferred to the green block. Further, as a result of the wear of both the pallet and lugs, on occasion, the lugs will not catch the pallet as each set of lugs are pulled down the conveyor. This will cause the block machine to complete the cycle with no pallet under the mold. As a result thereof, molded green blocks are dumped on the ground creating both a maintenance and clean up problem, in addition to a loss of material. Further, the pallet that is missed can jam in the machine which requires the machine to be shut down to remove the jammed pallet causing a decrease in operating efficiency. In addition, a jam in the machine may cause the timing bolt to shear requiring the entire system to be resynchronized.

The disadvantages noted above with respect to the known dependent pallet delivery systems are significant and represent an unsatisfactory mechanism that requires maintenance and impacts on the quality of the molded blocks. It is, therefore, desirable to provide an improved pallet delivery system, and more specifically, an independent delivery system which works independently of the cam driven block machine, but is timed to work integrally therewith to form blocks to overcome the disadvantages of the prior art.

SUMMARY OF THE INVENTION

Generally speaking, in accordance with the present invention, an independent pallet delivery system for transporting pallets to a cam driven block machine that delivers formed green blocks to pallets is provided. The independent pallet delivery system is provided with a storage assembly for holding pallets. A conveyor assembly is provided for transporting the pallets from the storage assembly to the cam driven block machine. A delivery assembly is provided for delivering the pallets from the storage assembly to a position above the conveyor assembly. A displacement assembly displaces the conveyor assembly between a first elevational position and a second elevational position. The displacement assembly raises the conveyor assembly into engagement with the pallet so that the pallet is taken downstream by the conveyor assembly. The conveyor assembly then transports each pallet downstream to the cam driven block machine to a green block receiving position. The cam driven block machine lifts the pallet when the pallet arrives at the green block receiving position so that a green block can be formed and displaced thereon. The cam driven block machine then lowers the pallet back to the conveyor assembly. As the cam driven block machine lowers the pallet, the conveyor assembly is displaced by the displacement assembly from the second elevational position to the first elevational position to cushion the return of the pallet to the conveyor. The conveyor assembly then outputs the pallet from the independent pallet delivery system with the newly formed green blocks thereon.

Accordingly, it is the object of the present invention to provide an improved pallet delivery system for use with a concrete block forming machine.

Another object of the present invention is to provide a pallet delivery system for use with a block machine which operates smoothly and consistently and which minimizes the down time of the block forming machine.

A further object of the present invention is to provide a pallet delivery system which reduces the amount of vibration to improve the quality of the block delivered thereto.

A further object of the present invention is to provide a pallet delivery system which provides improved handling of green blocks.

Yet a further object of the present invention is to provide a pallet delivery systems which virtually eliminates wear and bending of pallets during use.

Still a further object of the present invention is to provide an independent pallet delivery system that cushions the receipt of a newly formed block on the pallet after the block has been stripped from the mold.

A further object of the present invention is to provide an improved pallet delivery system which places the pallet with the freshly made blocks on the conveyor at precisely the same speed as the moving conveyor to reduce the potential of cracking.

Still other objects and advantages of the invention will in part be obvious and will in part be apparent from the specification.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
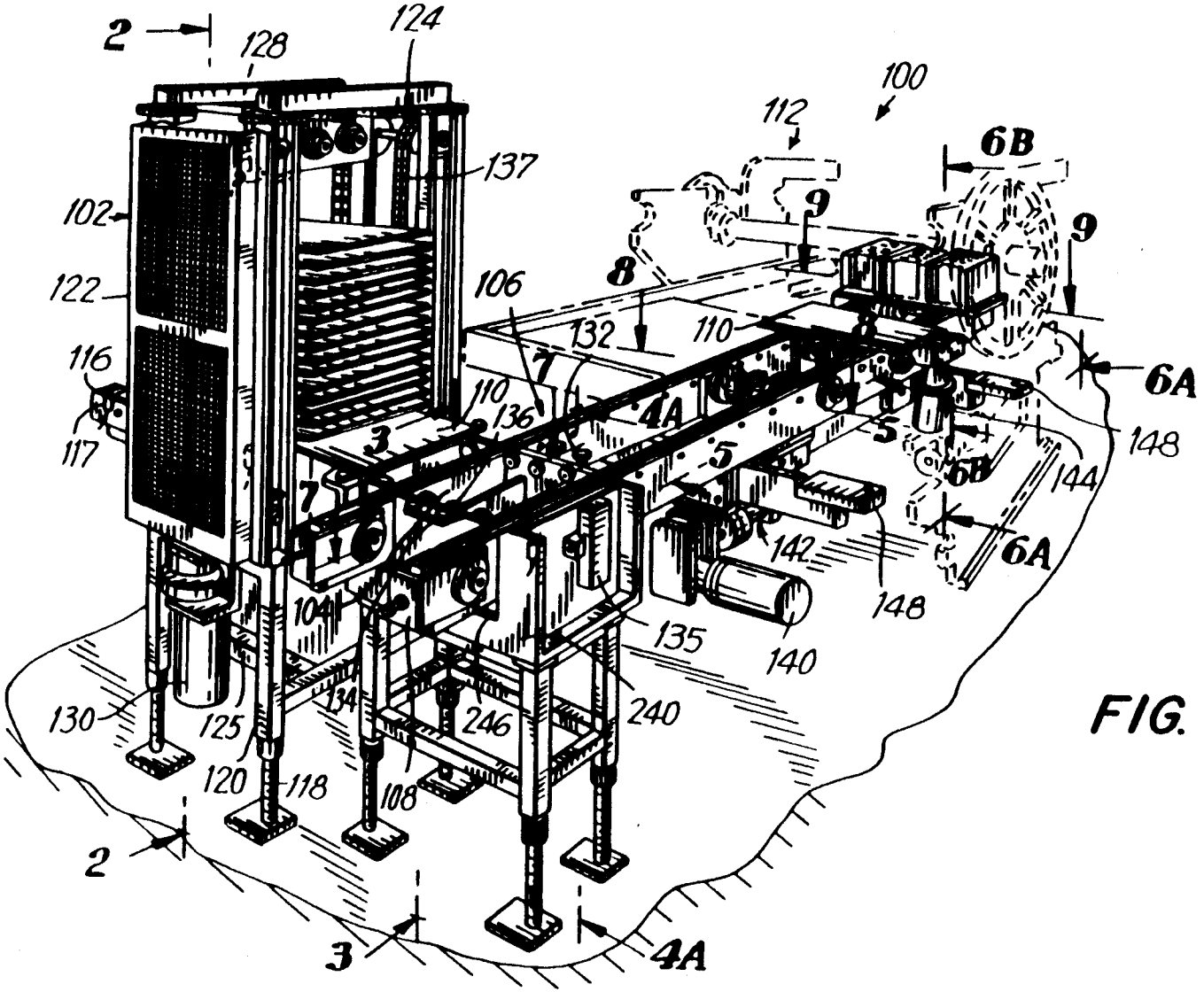
FIG. 1 is a perspective view of an independent pallet delivery system constructed in accordance with a preferred embodiment of the invention.

Reference is first made to FIG. 1 wherein an independent pallet delivery system, generally shown as 100 is depicted. Independent pallet delivery system 100 includes three basic assemblies, a pallet magazine assembly generally indicated 102, at a pallet conveyor assembly generally indicated as 106 and a jacking assembly generally indicated as 142. Independent pallet delivery system 100 is positioned and engaged with cam driven block machine 112 (illustrated in phantom) by mounting pads 148 in order to permit the delivery of pallets to the position where the freshly formed green blocks are stripped from the block forming machine and delivered to the pallet to be taken away from the block forming machine.

As is explained in detail below, pallet delivery system 100 is independently timed with respect to the cam driven block machine 112. Cam driven block machine 112 is designed to lift a pallet 110 from a pallet conveyor 106. When the pallet is at the cam driven block machine 112, concrete blocks are molded on the pallet, and then stripped from their mold on said pallet (not shown). Cam driven block machine 112 then places the newly made blocks (i.e. green blocks) onto pallet conveyor 106. U.S. Pat. No. 2,692,418 issued to J. H. Besser on Oct. 26, 1954 entitled PALLET HANDLING SYSTEM discloses in detail the operation of forming concrete blocks in a cam driven block machine. Moreover, there are other methods for forming a cement blocks. The methods and structures described in U.S Pat. No. 2,692,418 are well known, are not deemed to be part of the instant invention and are incorporated herein by references as if fully set forth herein.

Figure 2:
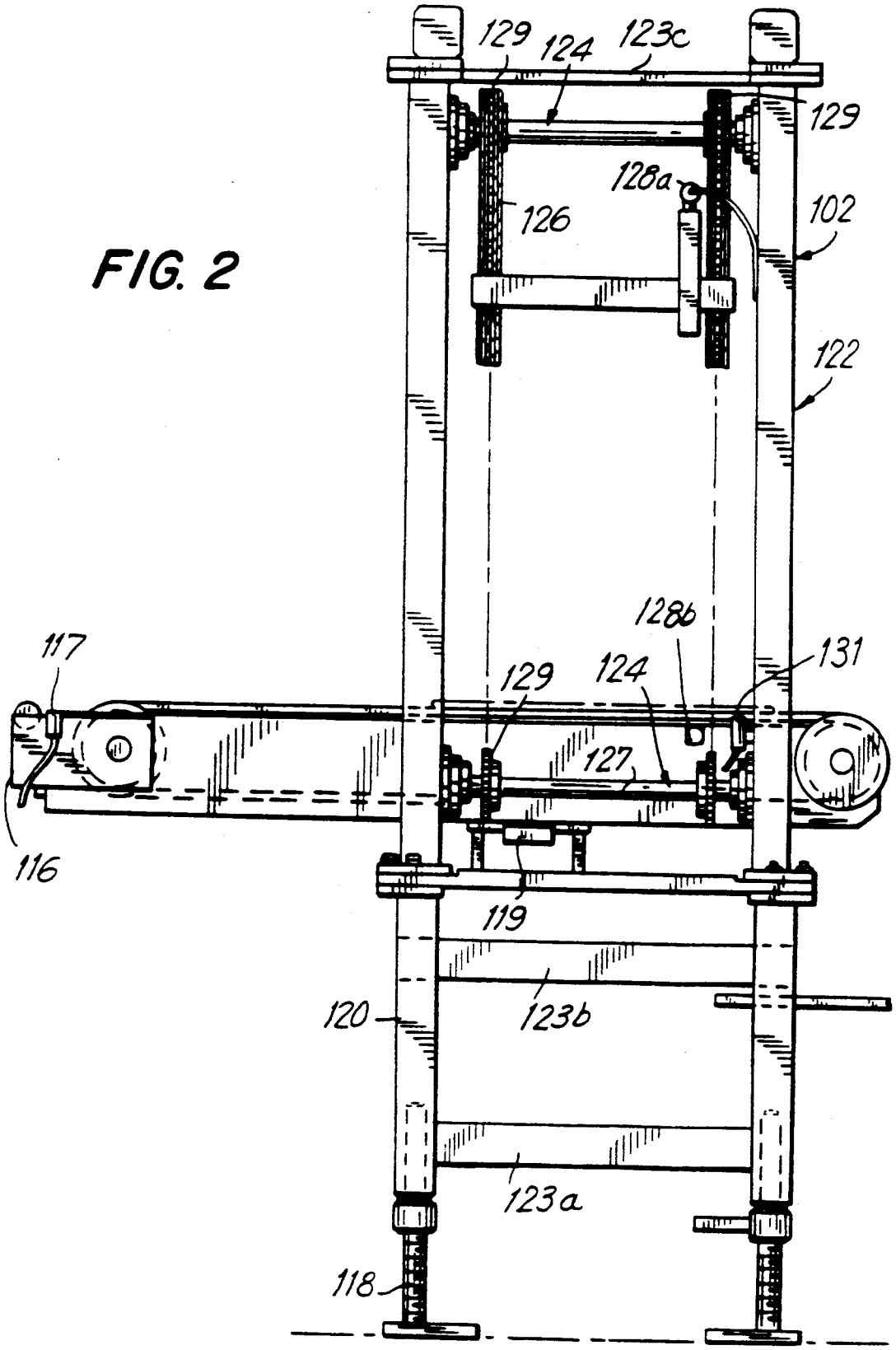
FIG. 2 is a sectional view taken along lines 2—2 of FIG. 1.
Figure 3:
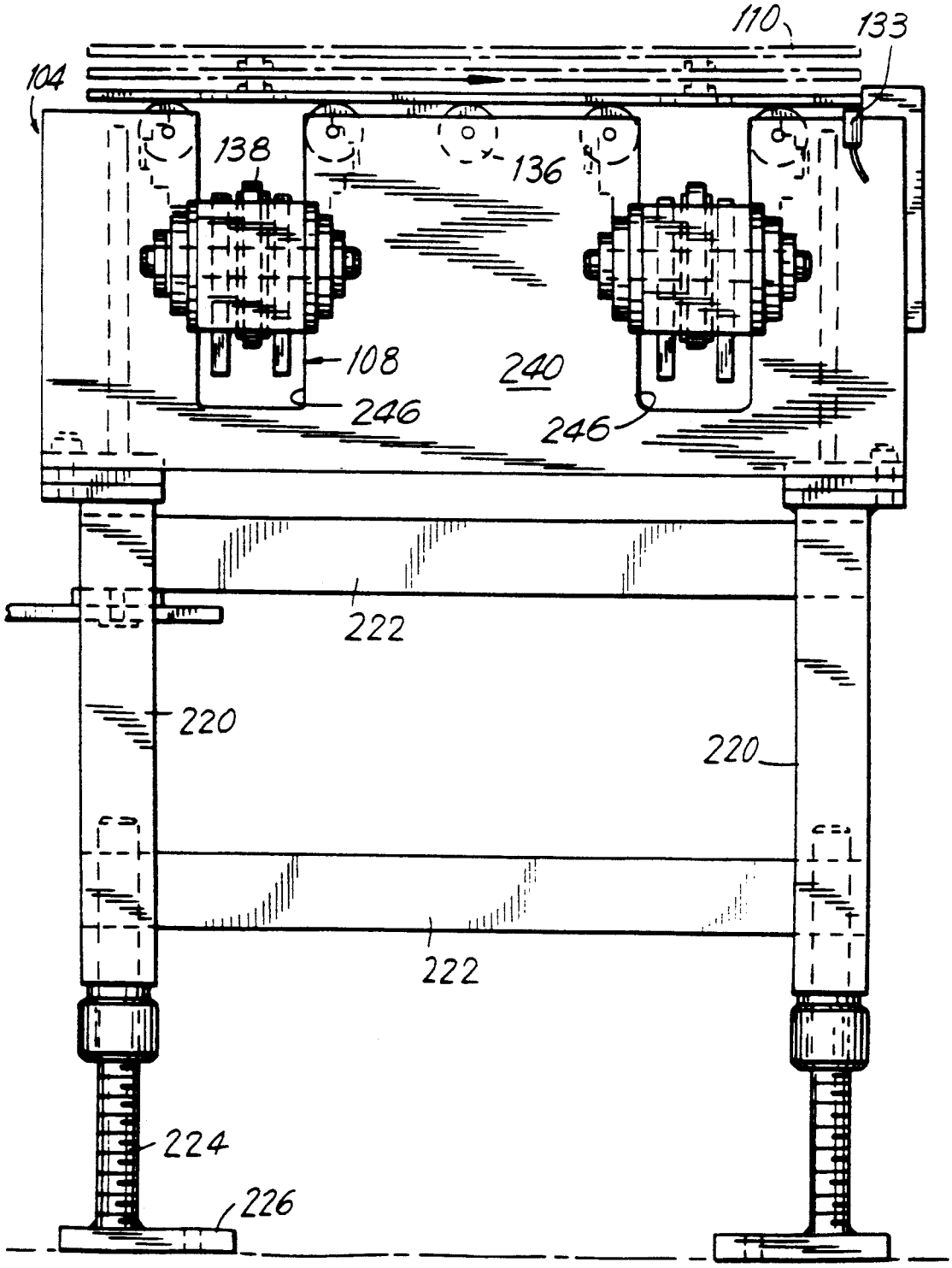
FIG. 3 is a sectional view taken along line 3—3 of FIG. 1.
Figure 7:
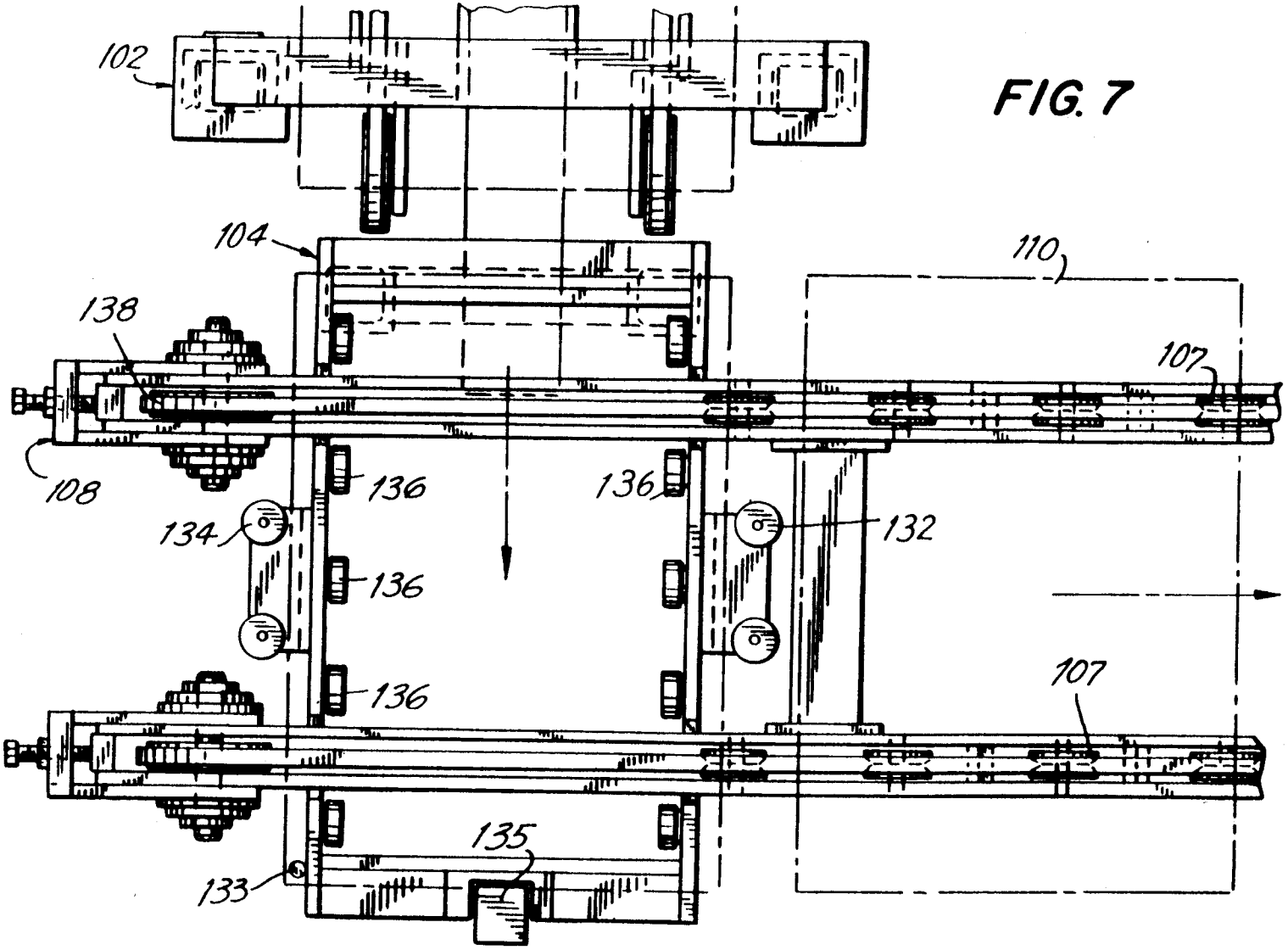
FIG. 7 is a sectional view taken along line 7—7 of FIG. 1.

Reference is first made to FIGS. 1, 2 and 7 wherein the pallet magazine assembly 102 is depicted. Pallet magazine assembly 102 includes four upright beams 120 having adjustable legs 118 anchored to foot pads 120 to stabilize beams 120. Beams 120 are anchored into a housing structure by cross-members **123*a*, 123*b* and 123*c* and by cross-struts 125 secured between cross-members 123*a*, 123*b* and 123*c***.

With reference to FIGS. 1 and 2, beams 120 rotatably support a pair of spaced apart tractor and sprocket assemblies, generally indicated as 124. Each tractor and sprocket assembly 124 includes an axle 127 joined between beams 120 for supporting sprockets 129 thereon. Roller chains 126 are driven by sprockets 129.

A gear-motor 130 is coupled to the pulley assembly 124 and causes the sprocket assemblies 124 to lower and raise the pallets. Also, a pallet return conveyor 116 is positioned at the entry side of magazine 102 for delivering pallets into pallet magazine 102. Specifically, roller chains 126 include a plurality of opposed studs that are aligned to receive and support pallets delivered into the magazine assembly so that two parts of opposed studs 137 capture the pallets and allow the pallets to be raised and/or lowered within the magazine assembly until the magazine assembly is full or emptied as the case may be.

A magnetic proximity switch **128*b* is provided at the bottom of pallet magazine 102 (FIG. 2) for detecting when magazine assembly has reached a maximum capacity. When magnetic proximity switch 128*b* is activated, pallet return conveyor 116 is shut down. Pallet return conveyor 116 is positioned adjacent the entrance side of pallet magazine 102. Pallet return conveyor 116 delivers pallets into pallet magazine 102. In particular, gear-motor 130 lowers and raises sprocket assembly 124 in accordance with the demand of pallet conveyor assembly 106**.

Pallets 110 are indexed in pallet magazine 102 by sprocket assembly 124. More specifically, each pallet 110 is delivered into the magazine at the positions defined by the opposed lugs 137. Next, gear-motor 130 lifts each pallet 110 upwards in the pallet magazine 102. In this manner, the pallets are stored in pallet magazine 102 one on top of each other with a gap or space formed between each pallet. Therefore, the stored pallets are separated one from the other and do not contact and rub against each other. This prevents the pallets from being worn down or damaged.

When the block machine has stopped, empty pallets will continue to be delivered from the pallet return conveyor 116 to pallet magazine 102 and are stored therein until the maximum capacity is reached. When the magazine is full, magnetic proximity switch **128*b* (FIG. 2) is activated to turn off the operation of pallet magazine 102. When the pallets are again needed, pallet magazine 102 indexes in reverse, conveying pallets 110 into a pick-up position 104, as needed, until the magazine minimum level is reached by the determination of a upper magnetic proximity switch 128*a* (FIG. 2). Magnetic proximity switch 128*a* is positioned at the upper sprocket 129 of pallet magazine 102**.

In addition, a magnetic proximity switch 117 is provided to sense the pallet entering pallet magazine 102 from pallet return conveyor 116. Further, a magnetic proximity switch 131 determines if the pallet is properly positioned in pallet magazine 102, while a magnetic proximity switch 119 determines if the pallets are indexed properly. All information received by all the magnetic proximity switches disclosed herein is transmitted to a control panel which analyzes the information to control the operation and movements of independent pallet delivery system 100.

Referring specifically to FIG. 7, pallets are delivered from pallet magazine assembly 102 to pick-up position 104 by rollers 136 and by left and right roller guides 132 and 134 which accurately guide the pallet to rest at a position that is above pallet conveyor 106. A bumper 135 stops each pallet at pick-up position 104. A magnetic proximity switch 133 is provided to determine when the pallet is positioned in pick-up position 104. At the time the pallet is delivered to pick-up position 104, pallet conveyor 106 is positioned at an elevation below pick-up position 104. As is explained below, pallet conveyor 106 is raised into engagement with each pallet at pick-up position 104 and transports the pallet downstream to the cam driven block machine 112.

Referring next to FIGS. 1, 3, 4A, 4B, 6A, 6B, 7 and 9, pallet conveyor assembly 106 includes a conveyor belt 138 and a support mechanism generally indicated as 210. Support mechanism 210 includes beams 220 having adjustable legs 224 secured to foot pads 226 for supporting the beams and permitting the support frame to be adjusted to avoid any movement.

Support mechanism 210 supports a conveyor housing 240 which is adapted to receive therein conveyor assembly 106. Conveyor housing 240 is combined with bottom wall 242 anchored to frame 220 and opposed lateral upright walls 244, each having a U-shaped cutouts 246 therein for permitting conveyor assembly 106 to be guided therein.

Referring next to FIGS. 4A, 4B, 6A, 6B and 9, pallet conveyor assembly 106 has a pulley configuration for supporting conveyor belt 138. Pallet conveyor 106 is driven by conveyor driving end wheels 146 and 147 and is further supported b conveyor guide wheels 107 positioned along the length of conveyor belt 138 between conveyor driving end wheels 146 and 147. Pallet conveyor 106 is driven by conveyor driving servo motor 144 illustrated in FIG. 6A, 6B and 9.

Pallet conveyor 106 is controlled by servo-motor 144 which drives a timing belt 166. Timing belt 166 is driven connected to conveyor driving wheels 164 and 165 and is guided by a conveyor driving belt guide 168. A common shaft 167 is connected through conveyor driving wheel 164 to connect timing belt 166 to driving end wheels 147 of pallet conveyor 106. In this manner, timing belt 166 is driven to rotate common shaft 167 and in turn cause conveyor belt 138 of pallet conveyor 106 to be rotated.

Figure 6A:
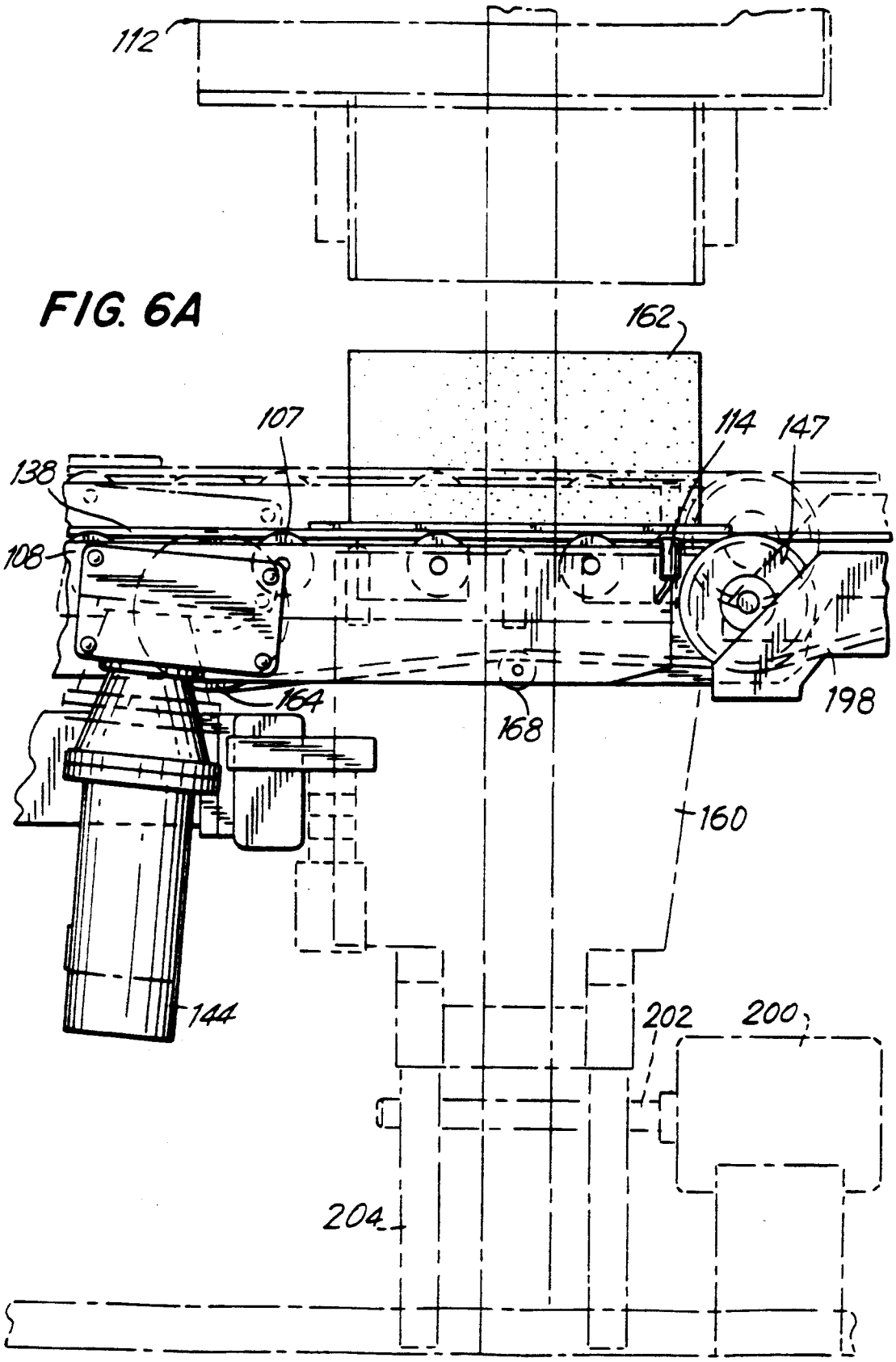
FIG. 6A is a sectional view taken along line 6—6 of FIG. 1.
Figure 6B:
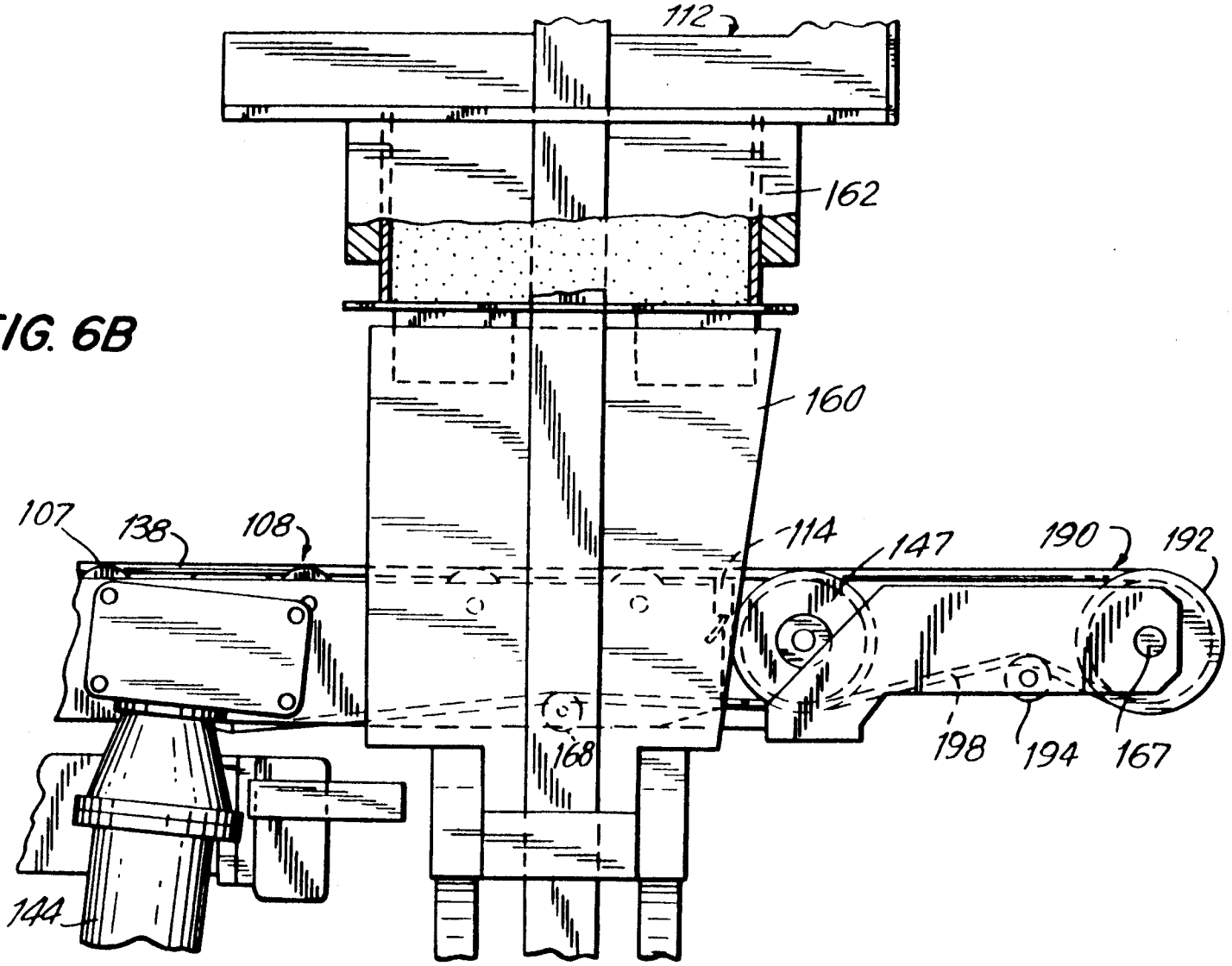
FIG. 6B is a similar sectional view of the conveyor depicted in FIG. 6A with the conveyor displaced into an up position.
Figure 9:
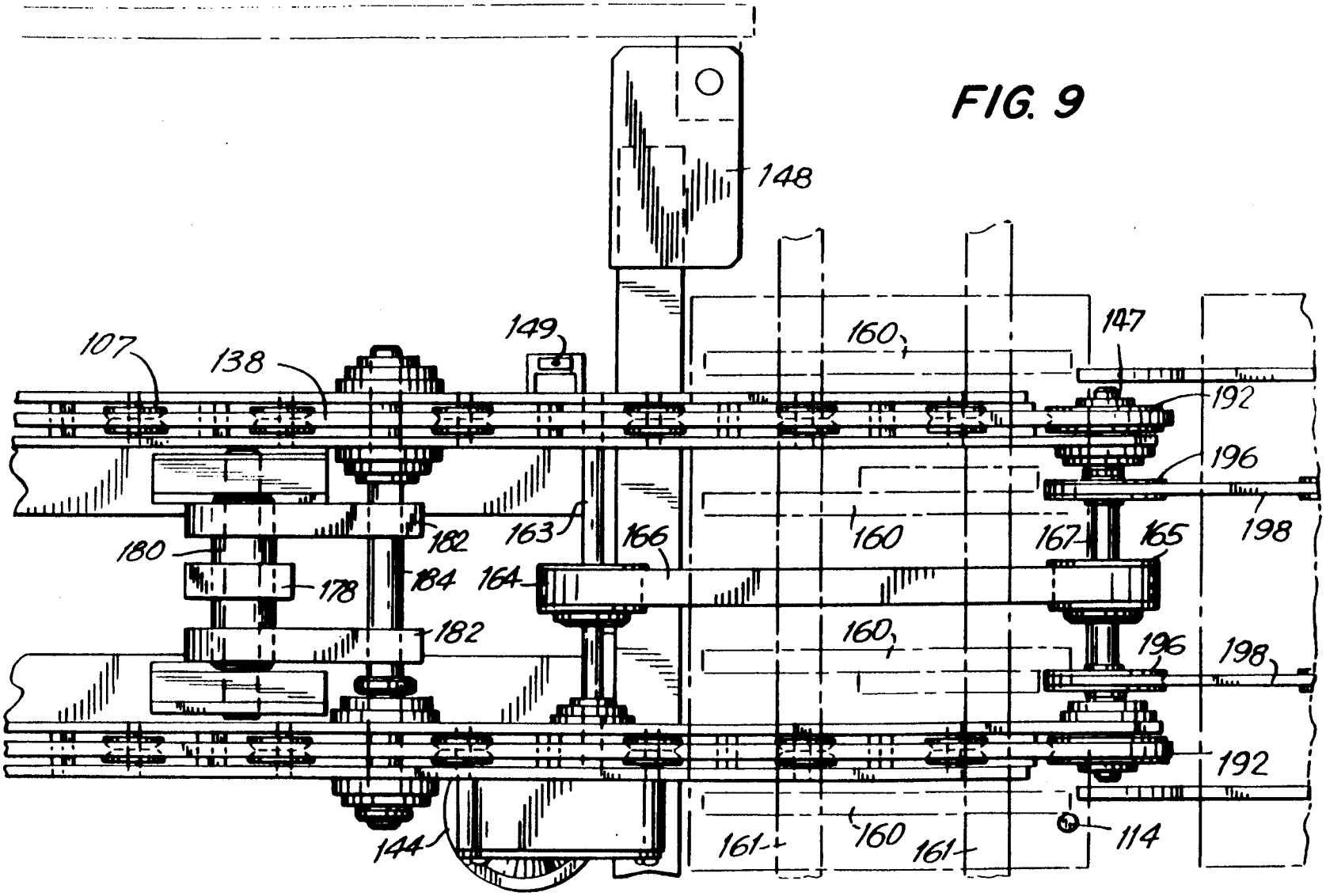
FIG. 9 is a sectional view taken along line 9—9 of FIG. 1.

A conveyor extension 190 is provided downstream of pallet conveyor 106 (FIG. 6B). Conveyor extension 190 is also connected to rotatable shaft 167. As shown in FIGS. 6B and 9, driving wheels 192 and 196 support and drive conveyor belt 198. Further, a guide wheel 194 is provided to guide conveyor belt 198 during operation. Shaft 167 drives conveyor extension 190 in the same manner and rate as pallet conveyor 106.

Figure 5:
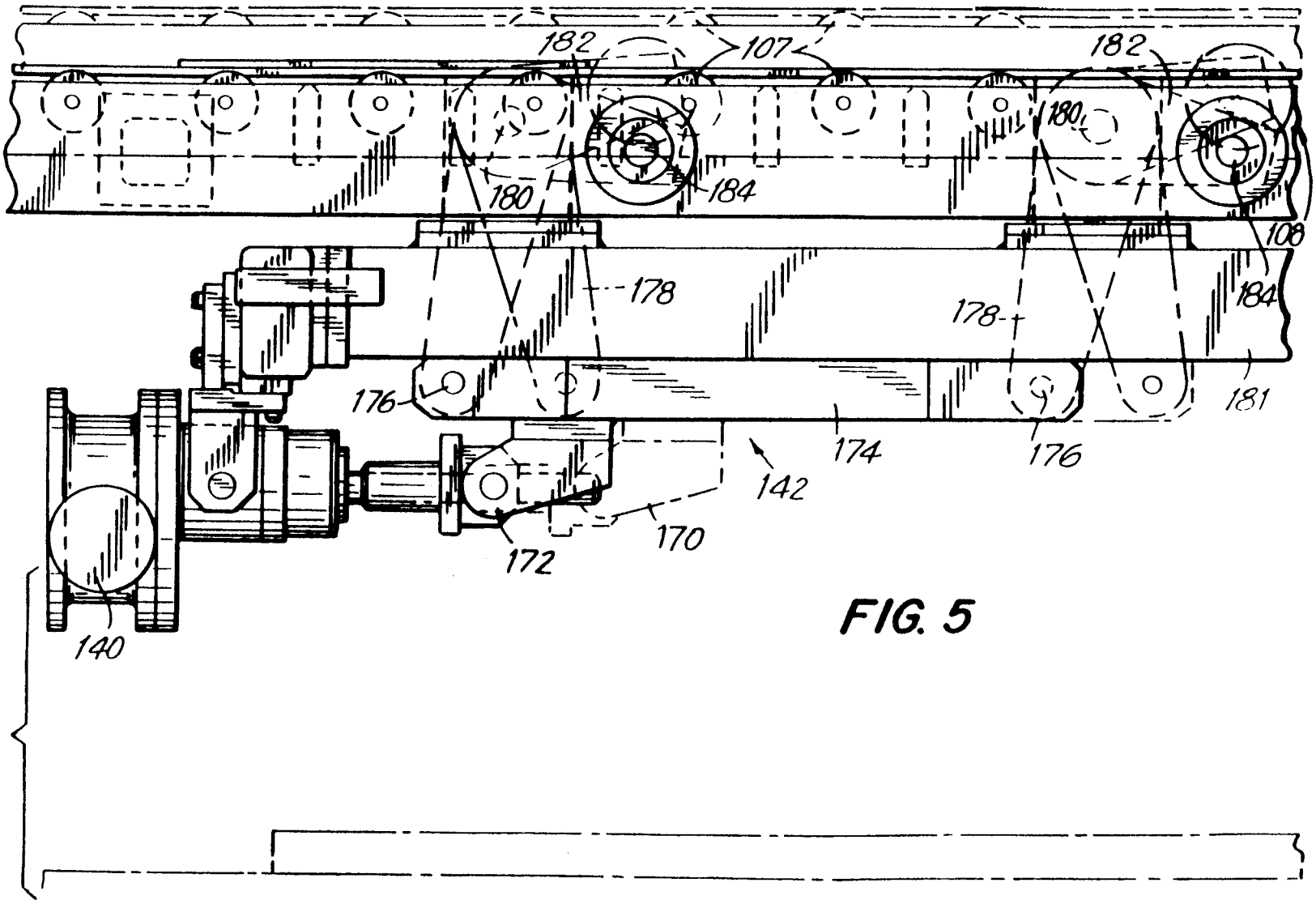
FIG. 5 is a sectional view taken along line 5—5 of FIG. 1.
Figure 8:
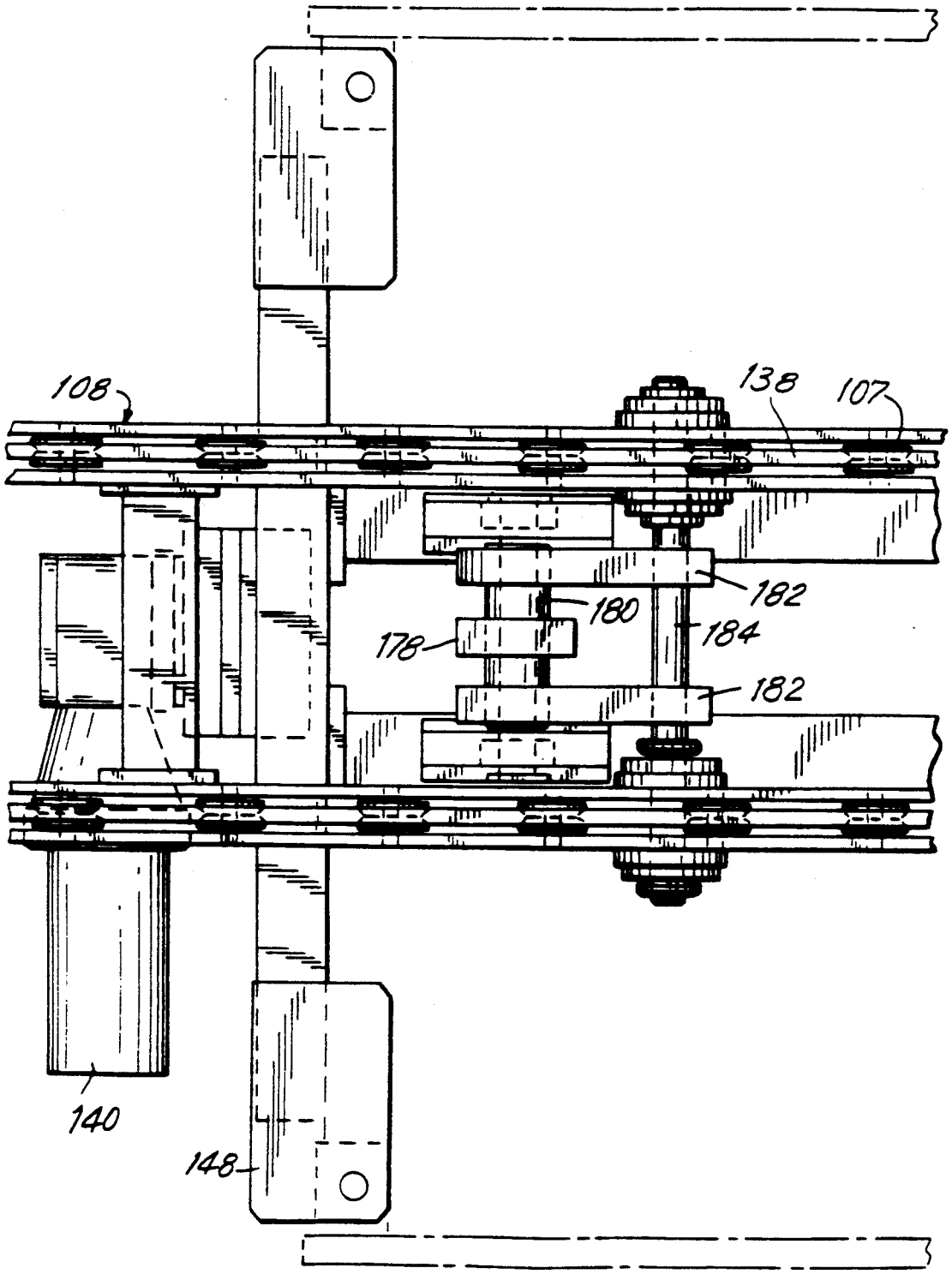
FIG. 8 is a sectional view of the conveyor taken along line 8—8 of FIG. 1.

Pallet conveyor 106 is disposed at a lower position than pick-up position 104. Accordingly, pallet conveyor 106 must be elevated to a position higher than the position of the pallet in order for the pallet to be taken away. Pallet conveyor 106 is elevated by the combination of a servo motor 140 together with a jacking assembly 142, which is best illustrated in FIGS. 5, 8 and 9.

A jacking assembly 142 is mounted by stationary mount 181 to frame 220. Servo motor 140 is mounted to a ball screw 170 through a pivot point 172. Ball screw 170 moves in a horizontal direction to move a driving plate 174 in a horizontal direction. Driving plate 174 is connected to lifting arms 172 which in turn are each connected at each end of driving plate 174 to define pivot positions 176. Each lifting arm 178 is mounted through a shaft 180 to a pair of positioning arms 182. Shaft 180 is stable and is integrally mounted to supports 108. The other ends of positioning arms 182 are each connected at pivot position 184 to the support 108 of pallet conveyor 106. In this manner, as servo motor 140 drives ball screw 170, pallet conveyor 106 is moved by the movement of support 108 in the down direction shown in FIG. 5.

Figure 4A:
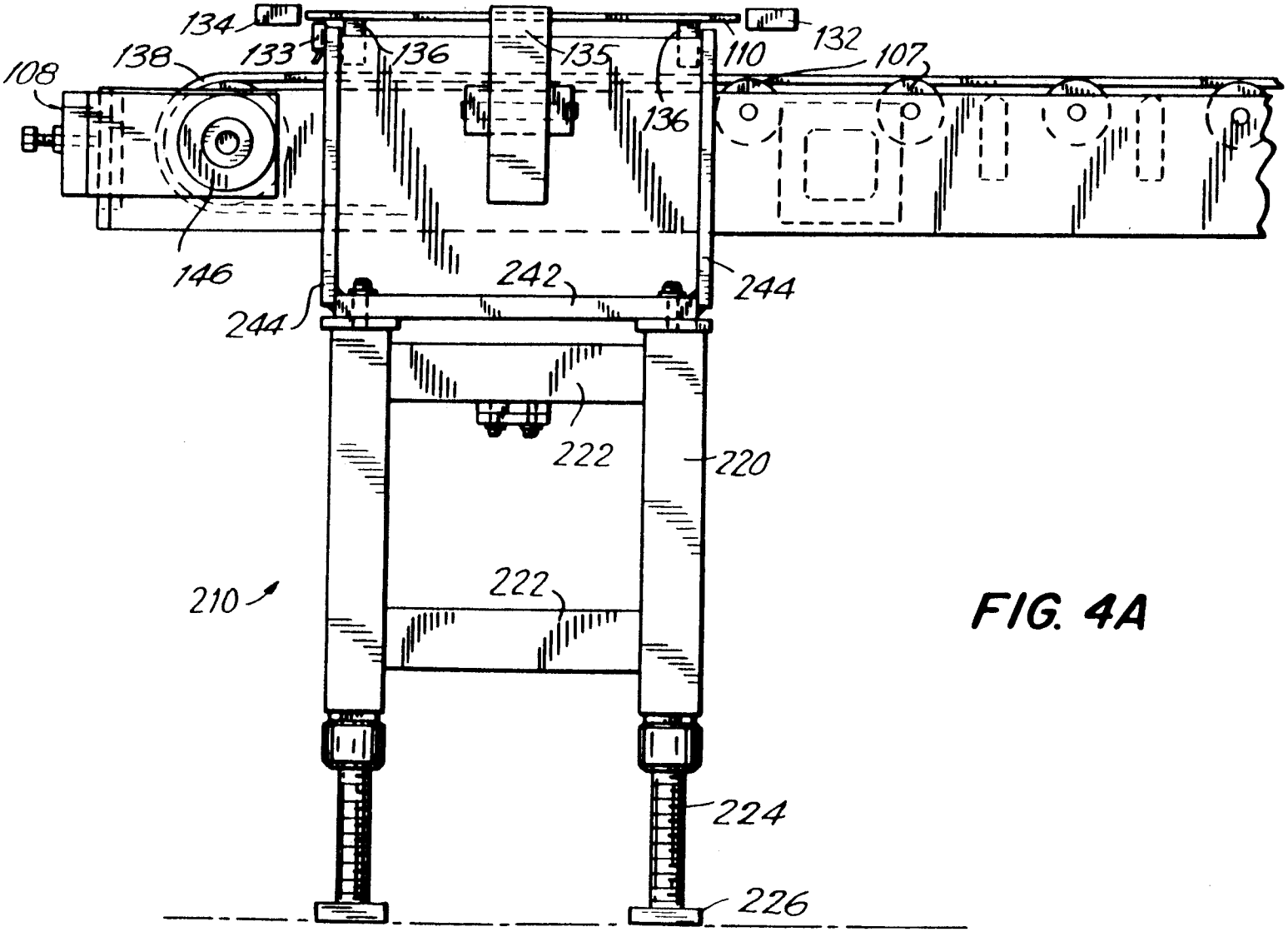
FIG. 4A is a sectional view of the conveyor in a down position taken along line 4—4 of FIG. 1.
Figure 4B:
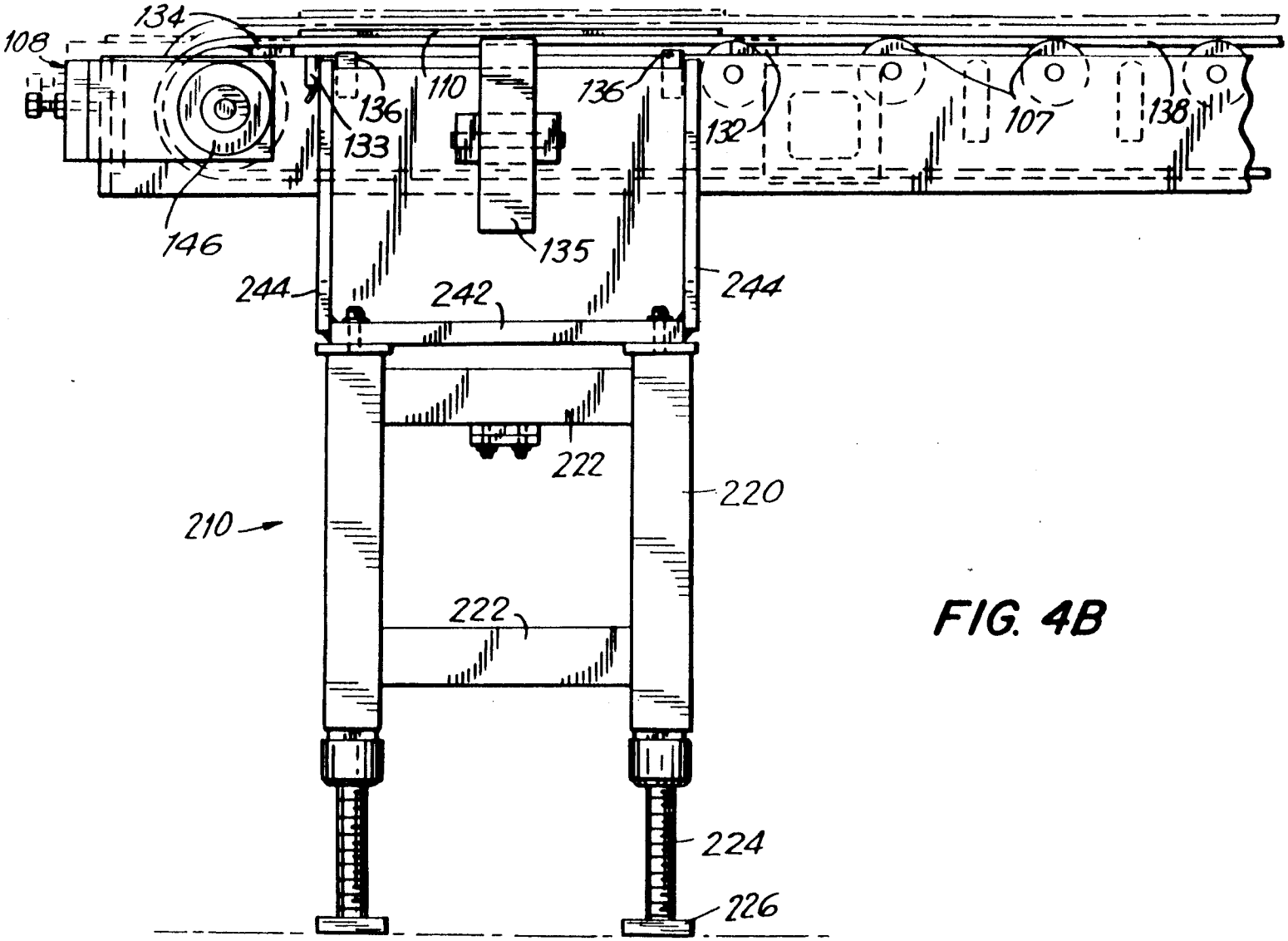
FIG. 4B is a similar sectional view of the conveyor depicted in FIG. 4A with the conveyor displaced into an up position.

Referring specifically to FIGS. I, 3, 4A, 4B, 5, 6A, 6B, 7 and 8, the operation of independent pallet delivery system 100 will now be described in detail. As previously set forth above, a pallet is delivered from pallet magazine assembly 102 and rests in pick-up position 104 above pallet conveyor 106. At this time, pallet conveyor 106 is disposed in a first position, which is the lowest elevational position. After delivery of the pallet to the pick-up position, pallet conveyor 106 is lifted approximately three (3) inches from its lower-most elevational position to a second position thereby lifting the pallet 110 above the pick-up position 104 shown in FIG. 4A. In FIG. 4A the pallet conveyor 106 is depicted in a first lower position compared to FIG. 4B, which depicts pallet conveyor 106 in its second or highest position. More specifically, FIG. 4B, shows a dashed line pallet conveyor 106 in its second upper-most position and shows the next stage of operation in solid lines.

After pallet conveyor 106 is raised upwards three (3) inches into engagement with the pallet, the pallet is immediately taken downstream by the conveyor toward the receiving position at the cam driven block machine 112. Pallet conveyor 106 is lowered approximately one and one-half (1½) inches to the third position as the pallet is transported downstream by the pallet conveyor 106 towards the receiving position, to clear the pallet pick up area. As the pallet is transported along pallet conveyor 106, the next pallet is delivered from pallet magazine 102 to the pallet pick-up position 104 above pallet conveyor 106. A magnetic proximity switch 149, located behind the block forming machine is provided to verify that the pallet has reached the location behind the receiving position of the cam driven block machine 112. The pallet conveyor 106 is stopped by the controller of the servo drive 144 finally bringing the pallet to rest behind the receiving position.

The operation for lifting the pallet into cam driven block machine 112 to a forming and stripping position is part of the cam driven block machine and is best illustrated in FIGS. 6A, 6B. The pallet is located at the stripped position above pallet receiver 160. In the present embodiment, four pallet receiver plates 160 are depicted in FIG. 9. And are known as the pallet receiver of the cam driven block machine. Pallet receiver 160 is a series of four (4) steel plates with rubber cushions inserted which move up and down to control the positioning of pallet 110. Lifting occurs due to the engagement between the top surfaces of pallet receiver 160 and the bottom surface of each pallet. Pallet conveyor 106 is arranged to fit between two of the four pallet receiver plates 160 without interfering with the movement of the pallet receiver. Pallet conveyor 106 is driven by the camming apparatus of cam driven block machine 112 which lifts a pair of arms to raise pallet receiver 160.

Alternatively, pallet receivers 160 are driven by a motor 200 which drives a shaft 202 connected to supports 204. Newly formed green blocks on the pallet are then stripped from the mold by cam driven block machine 112 and simultaneously lowered towards pallet conveyor 106. The pallet with the newly formed green blocks are then lowered towards pallet conveyor 106.

As the pallet is raised up under the mold in cam driven block machine 112 by pallet drivers 160, the next pallet resting at pick-up position 104 is lifted by conveyor 106 and transported downstream to a position behind the receiving position. When the pallet with the newly formed block is lowered and plated on pallet conveyor 106 by pallet receiver 160, pallet conveyor 106 is driven forward so that the pallet with the newly formed green block thereon is received by the block takeaway conveyor, while at the same time the pallet behind the receiving position is moved into the position above pallet receiver 160 to be lifted under the mold in cam driven block machine 112 to a molding and stripping position.

Before both pallets are moved forward, pallet conveyor 106 is lowered approximately one (1) inch to cushion the contact of the pallet of newly formed block with conveyor 106. Both pallets are then powered forward until the pallet with the freshly formed block is on the conveyor extension 190 of pallet conveyor 106 and positioned over the green block takeaway conveyor. At this time, the conveyor is lowered by jacking assembly 142 approximately one-half (½) inch and the pallet with the newly formed blocks is deposited on the green block takeaway conveyor. This action is verified by a magnetic proximity switch 114. The pallet conveyor 106 then stops and the empty pallet is positioned over the pallet receiver 160 and in proper position to be raised up under the mold in block machine 112.

At the same time, while the pallet with the newly formed green blocks is taken away by conveyor extension 190, the speed of pallet conveyor 106 and conveyor extension 190 are commonly controlled by the same motor to insure they are the same. Therefore, the pallet with the freshly made green blocks is gently handled minimizing vibrations in the green blocks as the pallet is taken away towards the automated return conveyor.

The lowering procedure of the first one (1) inch drop to a third intermediate position cushions the impact of the newly formed green blocks as they are placed onto pallet conveyor 106. In this manner, the vibrations and shocks applied to the newly formed blocks are minimized. Each block is formed with greater smoothness, strength and consistency. Once the pallet with the newly formed concrete blocks is placed on pallet conveyor 106, the newly formed green block is taken away by conveyor extension 190 and placed on green block takeaway conveyor.

Accordingly, the timing sequence of independent pallet delivery system 100 is as follows. A pallet is delivered to pallet pick-up position 104. The pallet is then engaged by pallet conveyor 106 as it is lifted approximately three (3) inches and is transported downstream. As the pallet is transported downstream, the conveyor assembly is lowered by one and one-half (1½) inches. Sensor 149 verifies that the pallet has reached the position behind the receiving position with respect to cam driven block machine 112. Jacking assembly 142 causes pallet conveyor 106 to drop one (1) inch. When receiving pallet having formed blocks thereon and then drops another one-half (½) inch to place the pallet of formed blocks on the green block takeaway conveyor. At the same time, pallet conveyor 106 transports the pallet from behind the receiving position to a position where it will be lifted by the cam driven block machine 112 and moves the pallet with the new green blocks thereon to the green block takeaway conveyor. When each pallet is raised under the mold in the cam driven block machine 112 to receive a block thereon, pallet conveyor 106 is raised three (3) inches to carry another pallet to behind the receiving position in cam driven block machine 112.

Accordingly, during the lowering of pallet receiver 160, pallet conveyor 106 begins to accelerate forward again, thereby delivering a empty pallet from behind the receiving position to pallet receiver 160. At the same time, pallet conveyor 106 is being lowered by jacking assembly 142. Accordingly, as the pallet with the green blocks thereon is moving away from pallet receiver 160 towards conveyor extension 190 the next empty pallet is moved over pallet receiver 160. This cycle is completed over and over at approximately 8–10 second intervals.

In accordance with the invention, independent pallet delivery system 100 substantially reduces pallet jams. In particular, independent pallet delivery system eliminates skipped pallets, because of the manner in which pallets are stacked in pallet magazine 102, since a separation gap is formed between stacked pallets. Further, the conveyor belt system eliminates the heavy chain and lugs and emits less vibrations. Also the pallet transport system of the instant invention provides less moving parts, and therefore less maintenance and less down time. Based thereon, independent pallet delivery system 100 eliminates the necessity to resynchronize the machine caused by a sheared timing bolt.

Also, the elevational movement of independent pallet delivery system of the instant invention cushions the contact of the pallet with the green blocks by lowering pallet conveyor 106 at the same time, thereby reducing the number of cracked or weakened blocks. The mechanism which drops the conveyor uses programmable controls linked to servo mechanism 140 and magnetic proximity switches so that the conveyor can be dropped at approximately the same speed at which pallet 110 is coming down. In addition, after contact is made between pallet 110 and pallet conveyor 106, pallet conveyor 106 can decelerate to a smooth stop. In this manner, as the pallet receives the green blocks the pallets are accelerated forward to the speed of the take away conveyor by means of programmable controls linked to servo motor 144. In accordance therewith, independent pallet delivery system 100 can accelerate smoothly to the speed of the take away conveyor which greatly reduces the potential of cracking or weakening the blocks.

The overall design of independent pallet delivery system 100 requires very little maintenance during the life of the machine. The machine relies heavily on well known programmable controls and solid state circuitry working in connection with servo motors 140 and 144 and the magnetic proximity switches. Further, all moving parts of servos 140 and 144 are housed in sealed bearings which are rarely required to be replaced. Through the use of timing belts, feed belts and ball screws, the independent pallet delivery system is constructed to provide smooth, reliable and virtually maintenance free operation.

Accordingly, the independent pallet system prevents pallets from contacting each other during stacking. When an empty pallet enters the pallet magazine area, it is either picked up by the magazine and stored therein or passed through the pallet magazine to a pallet pick-up position.

In addition, the following claims should be intended to cover all kinds of block making machinery not limited to only the cam driven block machines. The independent pallet delivery system can be adapted to fit hydraulically driven machines as well as electro-mechanical machines.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An independent pallet delivery system for transporting pallets through a block forming machine that forms concrete blocks on a pallet, comprising: conveyor means for transporting pallets to a block forming machine; storage means for storing a plurality of pallets therein; delivery means associated with both the conveyor means and the storage means for delivering pallets from the storage means to a holding position above the conveyor means; and displacement means associated with the conveyor means for displacing the conveyor means between at least a first elevational position and a second elevational position, the displacement means being displaceable between the first elevational position and the second elevational position to elevate the conveyor means into engagement with the pallet at the holding position so that the pallet is carried away by the conveyor means, the conveyor means being adapted to deliver the pallet to a waiting position adjacent a block forming machine so that the pallet can be transferred from the conveyor means to the block forming machine, said conveyor means being further adapted to transfer the pallet from the waiting position to the block forming machine so that at least one molded concrete block is placed on the pallet prior to the molded block being released from the block forming machine, the block forming machine lowering the pallet, said displacement means being adapted to displace the conveyor means from the second elevational position to the first elevational position to cushion the return of the pallet to the conveyor means and a take away conveyor means.

2. The independent pallet delivery system of claim 1, further including a third elevational position, the displacement means displacing the conveyor means between the second elevational position and the third elevational position to lower the conveyor means when the pallet is being carried away by the conveyor means.

3. The independent pallet delivery system of claim 1, further including detection means for detecting the position of the pallet on the conveyor means as the pallet approaches the block forming machine.

4. The independent pallet delivery system of claim 3, wherein the detection means stops the conveyor means when the pallet is positioned at a waiting position adjacent the block forming machine.

5. The independent pallet delivery system of claim 4, wherein the block forming machine lifts the pallet from the waiting position.

6. The independent pallet delivery system of claim 2, further including detection means for detecting the position of the pallet on the conveyor means as the pallet approaches the block forming machine.

7. The independent pallet delivery system of claim 6, wherein the detection means stops the conveyor means when the pallet is positioned at a waiting position adjacent the block forming machine.

8. The independent pallet delivery system of claim 7, wherein the block forming machine lifts the pallet from the waiting position.

9. The independent pallet delivery system of claim 1, further including detection means for detecting when the block forming machine begins to lower the pallet with the blocks formed thereon, the displacement means displacing the conveyor means in response to the detection means.

10. The independent pallet delivery system of claim 8, further including detection means for detecting when the block forming machine begins to lower the pallet with the blocks formed thereon, the displacement means displacing the conveyor means in response to the detection means.

11. The independent pallet delivery system of claim 1, further including a fourth elevational position, the displacement means displacing the conveyor means between the second elevational position and the fourth elevational position when the block forming machine lowers the pallet with the molded blocks thereon so that the conveyor means moves downward to first cushion the return of the pallet.

12. The independent pallet delivery system of claim 11, further including a fifth elevational position, the displacement means displacing the conveyor means between the fourth elevational position and the fifth elevational position when the block forming machine lowers the pallet with the molded blocks thereon so that the conveyor means moves downward to further cushion the return of the pallet.

13. The independent pallet delivery system of claim 10, further including a fourth elevational position, the displacement means displacing the conveyor means between the second elevational position and the fourth elevational position when the block forming machine lowers the pallet with the molded blocks thereon so that the conveyor means moves downward to first cushion the return of the pallet.

14. The independent pallet delivery system of claim 13, further including a fifth elevational position, the displacement means displacing the conveyor means between the fourth elevational position and the fifth elevational position when the block forming machine lowers the pallet with the molded blocks thereon so that the conveyor means moves downward to further cushion the return of the pallet.

15. The independent pallet delivery system of claim 1, wherein the conveyor means and the take away conveyor means move at the same speed.

16. The independent pallet delivery system of claim 12, wherein the conveyor means and the take away conveyor means move essentially at the same speed.

17. The independent pallet delivery system of claim 1, wherein the distance between the first elevational position and the second elevational position is approximately three inches when the conveyor means is elevated towards the delivery means.

18. The independent pallet delivery system of claim 1, wherein the distance between the second elevational position and the first elevational position is approximately one and one-half inches when the conveyor means moves downward to receive the pallet with the molded blocks from the block forming machine.

19. The independent pallet delivery system of claim 2, wherein the distance between the second elevational position and the third elevational position is approximately one inch when the conveyor means is lowered to carry the pallet to the block forming machine.

20. The independent pallet delivery system of claim 11, wherein the distance between the second elevational position and the fourth elevational position is approximately one inch when the conveyor means first moves downward to receive the pallet with the molded blocks from the block forming machine.

21. The independent pallet delivery system of claim 10, wherein the distance between the fourth elevational position and the fifth elevational position is approximately one-half inch when the conveyor means further moves downward to receive the pallet with the molded blocks from the block forming machine.

22. The independent pallet delivery system of claim 1, further including an automated conveyor associated with the take away conveyor means for transporting the pallets with the molded blocks from the independent pallet delivery system.

23. The independent pallet delivery system of claim 1, further including a return conveyor associated with the storage means for delivering pallets to at least one of the storage means and the delivery means.

24. The independent pallet delivery system of claim 1, wherein the conveyor means is formed with a belt.

25. The independent pallet delivery system of claim 24, wherein the belt is driven by a pulley system to form the conveyor means.

26. The independent pallet delivery system of claim 1, wherein the storage means is a pallet magazine for storing the pallet therein, the pallets being stored one on top of the other with a space therebetween.

27. The independent pallet delivery system of claim 26, wherein the pallet magazine is formed with a pulley system for lowering and raising the pallets stored therein, the pulley system having a v-belt for insertion of the pallets.

28. The independent pallet delivery system of claim 4, wherein the detection means is a magnetic proximity switch.

29. The independent pallet delivery system of claim 9, wherein the detection means is a magnetic proximity switch.

30. An independent pallet delivery system for transporting pallets through a block forming machine that forms concrete blocks and places each block on a pallet, comprising: conveyor means for transporting the pallets to the block forming machine to receive molded blocks formed by a block forming machine; storage means for storing a plurality of pallets therein; delivery means associated with both the conveyor means and the storage means for delivering pallets from the storage means to the conveyor means; and displacement means associated with the conveyor means for displacing the conveyor means between at least a first elevational position and a second elevational position, the conveyor means engaging the pallet from the delivery means so that the pallet is carried away by the conveyor means, the conveyor means being adapted to deliver the pallet to the block forming machine so that the pallet can be lifted from the conveyor means by the block forming machine, the block forming machine placing at least one molded concrete block on the pallet prior to the molded block being released from the block forming machine, the block forming machine lowering the pallet, the displacement means displacing the conveyor means from the first elevational position to the second elevational position to cushion the return of the pallet to the conveyor means and a take away conveyor means for removing the pallet from the block forming machine.

31. An independent pallet delivery system for transporting pallets through a block forming machine that forms concrete blocks and places each block on a pallet, comprising: conveyor means for transporting the pallets to the block forming machine to receive molded blocks formed by a block forming machine; storage means for storing a plurality of pallets therein; delivery means associated with both the conveyor means and the storage means for delivering pallets from the storage means to a holding position above the conveyor means; and displacement means associated with the conveyor means for displacing the conveyor means between at least a first elevational position and a second elevational position, the displacement means being displaceable between the first elevational position and the second elevational position to elevate the conveyor means into engagement with the pallet at the holding position so that the pallet is carried away by the conveyor means, the conveyor means being adapted to deliver the pallet to the block forming machine so that the pallet can be lifted from the conveyor means by the block forming machine, the block forming machine placing at least one molded concrete block on the pallet prior to the molded block being released from the block forming machine, the block forming machine lowering the pallet to the conveyor means and a take away conveyor means for removing the pallet from the block forming machine.

* * * * *